US006565229B2

(12) United States Patent
Bliss

(10) Patent No.: US 6,565,229 B2
(45) Date of Patent: May 20, 2003

(54) TELESCOPIC FLASHLIGHT

(76) Inventor: Charles D. Bliss, 20 Dumaine Ave., Nashua, NH (US) 03063-1033

( * ) Notice: Subject to any disclaimer, the term of this patent is extended or adjusted under 35 U.S.C. 154(b) by 129 days.

(21) Appl. No.: 09/777,298

(22) Filed: Feb. 6, 2001

(65) Prior Publication Data

US 2002/0105799 A1 Aug. 8, 2002

(51) Int. Cl.[7] ..... F21L 4/04
(52) U.S. Cl. ..... 362/198; 362/197
(58) Field of Search ..... 362/197, 198, 362/194, 270, 269

(56) References Cited

U.S. PATENT DOCUMENTS

| | | | | | |
|---|---|---|---|---|---|
| 1,755,472 | A | * | 4/1930 | Darlington | 362/198 |
| 4,544,990 | A | | 10/1985 | Wieselman et al. | 362/32 |
| 4,697,228 | A | | 9/1987 | Mui et al. | 362/352 |
| 4,870,543 | A | * | 9/1989 | Born et al. | 362/198 |
| 5,012,394 | A | * | 4/1991 | Woodward | 362/198 |
| 5,197,796 | A | | 3/1993 | Moore | 362/202 |
| 5,287,253 | A | | 2/1994 | Blorstad | 362/92 |
| 5,954,420 | A | | 9/1999 | Smith | 362/198 |
| 5,975,712 | A | | 11/1999 | Shiao | 362/120 |

* cited by examiner

*Primary Examiner*—Laura K. Tso
(74) *Attorney, Agent, or Firm*—Richard L. Miller, Registered Patent Agent

(57) ABSTRACT

A telescopic flashlight that includes a housing that is telescopic and hand-held, a battery interface that is disposed in the housing and interfaces with at least one battery, a bulb interface that is disposed relative to the housing, electrically communicates with the battery interface, and interfaces with a bulb, and circuity that is disposed in the housing and electrically communicates the bulb interface with the battery interface. The housing includes a handle portion that is held by a user and a body portion that is telescopically attached to, and extends from and retracts into, the handle portion thereof. The battery interface includes an on/off slide switch, a coil spring, and first, second, and third electrical connectors. The bulb interface includes a head, a bulb socket, and a beacon. The circuity includes positive and negative telescoping rods.

74 Claims, 1 Drawing Sheet

TELESCOPIC FLASHLIGHT

BACKGROUND OF THE INVENTION

1. Field of the Invention

The present invention relates to a flashlight. More particularly, the present invention relates to a telescopic flashlight.

2. Description of the Prior Art

Numerous innovations for extendable illuminating devices have been provided in the prior art that will be described. Even though these innovations may be suitable for the specific individual purposes to which they address, however, they differ from the present invention.

A FIRST EXAMPLE

U.S. Pat. No. 4,544,990 to Wieselman et al. teaches an illuminating telescopic device for use in a wide variety of applications, such as a signalling device, a conventional flashlight, an indicating light, a play light, and the like. The illuminating telescopic device includes one or more light transmissive extensible elements having a combined length greater than the length of its associated housing, so as to provide an effective signalling device when in use, while being compactly portable when stored within its housing.

A SECOND EXAMPLE

U.S. Pat. No. 4,697,228 to Mui et al. teaches a collapsible light wand that is formed from a telescopic tube assembly comprised of a plurality of overlapping translucent tube sections, the outermost tube section being attachable to the light end of a flashlight. A locking bar pivotally mounted to either the flashlight or to the outermost tube section may be swung over the ends of the tube sections when they ware in the nested (retracted) position. A storage cylinder large enough to receive the nested tube assembly may also be provided, and is preferably attachable to the rear end of the flashlight for ease of carrying.

A THIRD EXAMPLE

U.S. Pat. No. 5,197,796 to Moore teaches a conventional flashlight that is modified to provide greater brightness by providing an extension tube between the base cap and the body of the flashlight. The extension holds one or more additional batteries so that a higher voltage and brighter bulb can be substituted for the original flashlight bulb. In a preferred embodiment, the extension has the same outer diameter as the body of the original flashlight so that it fits in the same mounts as the original flashlight. Where the flashlight body and extension have a thin sidewall surrounding the batteries so that there is insufficient thickness available to form threads in the sidewall of the portion of the extension that mates with the body and still leave room for a battery to pass through, then the battery in the extension is spaced away from that end and a cylindrical insulated bushing with an axial electrical conductor is provided therein to make electrical connection between the battery in the extension and the battery in the body. A longer and more powerful flashlight is obtained with no wasted parts, and which accepts a higher voltage, brighter light bulb.

A FOURTH EXAMPLE

U.S. Pat. No. 5,287,253 to Blorstad teaches a combined light and fan assembly wherein a fan and light are combined into a single component and mounted in the electrical light socket in the interior of a conventional domestic oven so that when the oven is being heated, and the oven light switch is turned on, the light is illuminated, and the fan runs producing a convection current inside the oven, so that the conventional oven is converted into a convection oven.

A FIFTH EXAMPLE

U.S. Pat. No. 5,954,420 to Smith teaches a telescopic flashlight having at least two cylindrical barrels of different diameters interconnected to slide one within another, engaged when partially extended by set screws, and when fully extended by matching threads located on each cylindrical barrel. The telescopic flashlight includes means to provide an adjustable housing capable of being axially extended or compressed to retain at designated intervals, a variable number of batteries connected in series alignment accommodated by the actuation of one or more lamp bulbs positioned inside one head assembly. The telescopic flashlight is also provided with individual adapters for batteries of smaller size to be utilized in place of standard "D" size batteries.

It is apparent that numerous innovations for extendable illuminating devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a telescopic flashlight that avoids the disadvantages of the prior art.

ANOTHER OBJECT of the present invention is to provide a telescopic flashlight that is simple and inexpensive to manufacture.

STILL ANOTHER OBJECT of the present invention is to provide a telescopic flashlight that is simple to use.

BRIEFLY STATED, STILL YET ANOTHER OBJECT of the present invention is to provide a telescopic flashlight that includes a housing that is telescopic and hand-held, a battery interface that is disposed in the housing and interfaces with at least one battery, a bulb interface that is disposed relative to the housing, electrically communicates with the battery interface, and interfaces with a bulb, and circuity that is disposed in the housing and electrically communicates the bulb interface with the battery interface. The housing includes a handle portion that is held by a user and a body portion that is telescopically attached to, and extends from and retracts into, the handle portion thereof. The battery interface includes an on/off slide switch, a coil spring, and first, second, and third electrical connectors. The bulb interface includes a head, a bulb socket, and a beacon. The circuity includes positive and negative telescoping rods.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figures 1, 2, 3, 4:
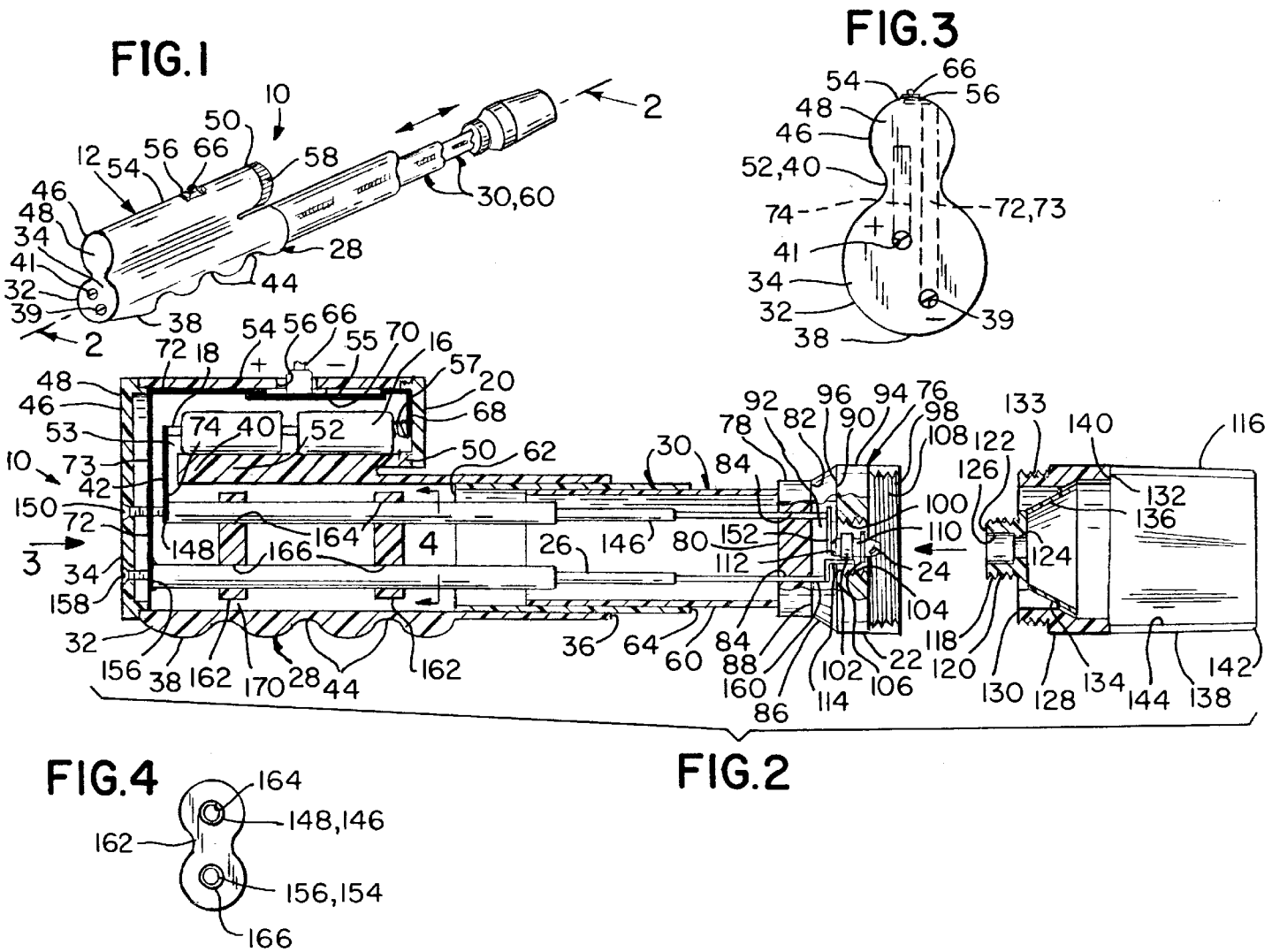
FIG. 1 is a diagrammatic perspective view of the present invention.
FIG. 2 is an enlarged partially exploded diagrammatic cross sectional view taken on line 2—2 in FIG. 1.
FIG. 3 is an enlarged diagrammatic end view taken generally in the direction of arrow 3 in FIG. 2.
FIG. 4 is an enlarged diagrammatic end view taken generally in the direction of arrow 4 in FIG. 2.

10 telescopic flashlight of present invention
12 housing for being hand-held
14 battery interface for interfacing with at least one battery 16
16 at least one battery
18 positive terminal of at least one battery 16
20 negative terminal of at least one battery 16
22 bulb interface for interfacing with bulb 24
24 bulb
26 circuity
28 handle portion of housing 12 for holding by user (not shown)
30 body portion of housing 12
32 lower portion of handle portion 28 of housing 12
34 rearwardmost wall of lower portion 32 of handle portion 28 of housing 12
36 forwardmost wall of lower portion 32 of handle portion 28 of housing 12
38 lowermost wall of lower portion 32 of handle portion 28 of housing 12
39 first circuitry affixing throughbore in rearwardmost wall 34 of lower portion 32 of handle portion 28 of housing 12
40 uppermost wall of lower portion 32 of handle portion 28 of housing 12
41 second circuitry affixing throughbore in rearwardmost wall 34 of lower portion 32 of handle portion 28 of housing 12
42 first passageway
44 finger recesses contained in lowermost wall of lower portion 32 of handle portion 28 of housing 12 for receiving fingers (no shown) of user (not shown)
46 upper portion of handle portion 28 of housing 12
48 rearwardmost wall of upper portion 46 of handle portion 28 of housing 12
50 forwardmost wall of upper portion 46 of handle portion 28 of housing 12
51 internal threads in forwardmost wall 50 of upper portion 46 of handle portion 28 of housing 12
52 lowermost wall of upper portion 46 of handle portion 28 of housing 12
53 second passageway
54 uppermost wall of upper portion 46 of handle portion 28 of housing 12
55 inner surface of uppermost wall 54 of upper portion 46 of handle portion 28 of housing 12
56 on/off switch throughbore in uppermost wall 54 of upper portion 46 of handle portion 28 of housing 12
57 inner surface of battery access cap 58 of upper portion 46 of handle portion 28 of housing 12
58 battery access cap of upper portion 46 of handle portion 28 of housing 12
59 external threads on battery access cap 58 of upper portion 46 of handle portion 28 of housing 12
60 at least one telescoping tube of body portion 30 of housing 12
62 rearwardmost end of at least one telescoping tube 60 of body portion 30 of housing 12
64 forwardmost end of at least one telescoping tube 60 of body portion 30 of housing 12
66 on/off slide switch of battery interface 14 for activating by thumb (not shown) of user (not shown) when handle portion 28 of housing 12 is held in hand (not shown) of user (not shown)
68 coil spring of battery interface 14 for electrically communicating with negative terminal 20 of at least one battery 16
70 first electrical connector of battery interface 14
72 second electrical connector of battery interface 14
73 depending portion of second electrical connector 72 of battery interface 14
74 third electrical connector of battery interface 14 for electrically communicating with positive terminal 18 of at least one battery 16
76 head of bulb interface 22
78 rearwardmost portion of head 76 of bulb interface 22
80 rearwardmost surface of rearwardmost portion 78 of head 76 of bulb interface 22
82 forwardmost surface of rearwardmost portion 78 of head 76 of bulb interface 22
84 pair of circuitry throughbores in rearwardmost portion 78 of head 76 of bulb interface 22
86 intermediate portion of head 76 of bulb interface 22
88 rearwardmost surface of intermediate portion 86 of head 76 of bulb interface 22
90 forwardmost surface of intermediate portion 86 of head 76 of bulb interface 22
92 circuitry throughbore in intermediate portion 86 of head 76 of bulb interface 22
94 forwardmost portion of head 76 of bulb interface 22
96 rearwardmost surface of forwardmost portion 94 of head 76 of bulb interface 22
98 forwardmost surface of forwardmost portion 94 of head 76 of bulb interface 22
100 bulb throughbore in forwardmost portion 94 of head 76 of bulb interface 22
102 rearwardmost portion of bulb throughbore 100 in forwardmost portion 94 of head 76 of bulb interface 22
104 internal threads extending axially in rearwardmost portion 102 of bulb throughbore 100 in forwardmost portion 94 of head 76 of bulb interface 22
106 forwardmost portion of bulb throughbore 100 in forwardmost portion 94 of head 76 of bulb interface 22
108 internal threads extending axially in forwardmost portion 106 of bulb throughbore 100 in forwardmost portion 94 of head 76 of bulb interface 22
110 bulb socket of bulb interface 22 for holding bulb 24 coaxially in rearwardmost portion 102 of bulb throughbore 100 in forwardmost portion 94 of head 76 and for extending bulb 24 coaxially into forwardmost portion 106 of bulb throughbore 100 in forwardmost portion 94 of the head 76 and coaxially into circuitry throughbore 92 in intermediate portion 86 of head 76 of bulb interface 22
112 positive terminal of bulb socket 110 of bulb interface 22 for electrically communicating with positive terminal of bulb 24
114 negative terminal of bulb socket 110 of bulb interface 22 for encircling, and electrically communicating with, negative terminal of bulb 24
116 beacon of bulb interface 22
118 rearwardmost portion of beacon 116 of bulb interface 22
120 external threads on rearwardmost portion 118 of beacon 116 of bulb interface 22

122 rearwardmost surface of rearwardmost portion 118 of beacon 116 of bulb interface 22
124 forwardmost surface of rearwardmost portion 118 of beacon 116 of bulb interface 22
126 bulb throughbore in rearwardmost portion 118 of beacon 116 of bulb interface 22 for receiving bulb 24
128 intermediate portion of beacon 116 of bulb interface 22
130 rearwardmost surface of intermediate portion 128 of beacon 116 of bulb interface 22
132 forwardmost surface of intermediate portion 128 of beacon 116 of bulb interface 22
133 external threads on intermediate portion 128 of beacon 116 of bulb interface 22
134 reflector throughbore in intermediate portion 128 of beacon 116 of bulb interface 22
136 reflector lining reflector throughbore 34 in intermediate portion 128 of beacon 116 of bulb interface 22
138 forwardmost portion of beacon 116 of bulb interface 22
140 rearwardmost surface of forwardmost portion 138 of beacon 116 of bulb interface 22
142 forwardmost surface of forwardmost portion 138 of beacon 116 of bulb interface 22
144 illuminating throughbore in forwardmost portion 138 of beacon 116 of bulb interface 22 for allowing bulb 24 to illuminate therethrough
146 positive rod of circuity 26
148 rearwardmost end of positive rod 146 of circuity 26
150 first screw of circuitry 26
152 forwardmost end of positive rod 146 of circuity 26
154 negative rod of circuity 26
156 rearwardmost end of negative rod 154 of circuity 26
158 second screw of circuity 26
160 forwardmost end of negative rod 154 of circuity 26
162 pair of spacers of circuity 26
164 uppermost throughbore in each spacer of pair of spacers 162 of circuitry 26
166 lowermost throughbore in each spacer of pair of spacers 162 of circuitry 26
168 first space of circuitry 26
170 second space of circuitry 26

DETAILED DESCRIPTION OF THE PREFERRED EMBODIMENT

Referring now to the figures, in which like numerals indicate like parts, and particularly to FIG. 1, the telescopic flashlight of the present invention is shown generally at 10.

The configuration of the telescopic flashlight 10 can best be seen in FIGS. 1–4, and as such, will be discussed with reference thereto.

The telescopic flashlight 10 comprises a housing 12 that is telescopic and is for being hand-held, a battery interface 14 that is disposed in the housing 12 for interfacing with at least one battery 16 that has a positive terminal 18 and a negative terminal 20, a bulb interface 22 that is disposed relative to the housing 12, electrically communicates with the battery interface 12, and is for interfacing with a bulb 24 that has a positive terminal and a negative terminal, and circuity 26 that is disposed in the housing 12 and electrically communicates the bulb interface 22 with the battery interface 14.

The housing 12 comprises a handle portion 28 for holding by a user (not shown), and a body portion 30 that is telescopically attached to, and extends from and retracts into, the handle portion 28 thereof.

The handle portion 28 of the housing 12 comprises a lower portion 32 that is slender, elongated, and tubular.

The lower portion 32 of the handle portion 28 of the housing 12 has a rearwardmost wall 34 that is closed and circular-shaped, and a forwardmost wall 36 that is open and circular-shaped.

The lower portion 32 of the handle portion 28 of the housing 12 further has a lowermost wall 38 that is closed and extends from the rearwardmost wall 34 thereof, to the forwardmost wall 36 thereof.

The rearwardmost wall 34 of the lower portion 32 of the handle portion 28 of the housing 12 has a first circuitry affixing throughbore 39 that extends axially therethrough and is disposed in proximity to the lowermost wall 38 of the lower portion 32 of the handle portion 28 of the housing 12.

The lower portion 32 of the handle portion 28 of the housing 12 further has an uppermost wall 40 that is partially open and extends from the forwardmost wall 36 thereof, to short of the rearwardmost wall 34 thereof so as to provide a first passageway 42 therebetween.

The rearwardmost wall 34 of the lower portion 32 of the handle portion 28 of the housing 12 further has a second circuitry affixing throughbore 41 that extends axially therethrough and is disposed in proximity to the uppermost wall 40 of the lower portion 32 of the handle portion 28 of the housing 12, and to one side of, and above, the first circuity affixing throughbore 39 therein.

The lowermost wall of the lower portion 32 of the handle portion 28 of the housing 12 contains finger recesses 44 therein that are axially spaced-apart and extend from the rearwardmost wall 34 of the lower portion 32 of the handle portion 28 of the housing 12, to approximately midway between the rearwardmost wall 34 of the lower portion 32 of the handle portion 28 of the housing 12 and the forwardmost wall 36 of the lower portion 32 of the handle portion 28 of the housing 12 for receiving the fingers (no shown) of the user (not shown).

The handle portion 28 of the housing 12 further comprises an upper portion 46 that is slender, elongated, and tubular.

The upper portion 46 of the handle portion 28 of the housing 12 has a rearwardmost wall 48 that is closed, circular-shaped, and coplanar with the rearwardmost wall 34 of the lower portion 32 of the handle portion 28 of the housing 12 so as to form a figure 8 therewith.

The upper portion 46 of the handle portion 28 of the housing 12 further has a forwardmost wall 50 that is open, circular-shaped, has internal threads 51, and extends from the uppermost wall 40 of, and forms a figure 8 with, the lower portion 32 of the handle portion 28 of the housing 12, and is disposed approximately midway between the rearwardmost wall 34 of the lower portion 32 of the handle portion 28 of the housing 12 and the forwardmost wall 36 of the lower portion 32 of the handle portion 28 of the housing 12.

The upper portion 46 of the handle portion 28 of the housing 12 further has a lowermost wall 52 that is partially coincident with the uppermost wall 40 of, and forms a figure 8 with, the lower portion 32 of the handle portion 28 of the housing 12.

The lowermost wall 52 of the upper portion 46 of the handle portion 28 of the housing 12 is partially open and extends from the forwardmost wall 50 of the upper portion 46 of the handle portion 28 of the housing 12, to short of the rearwardmost wall 48 of the upper portion 46 of the handle portion 28 of the housing 12 so as to provide a second passageway 53 therebetween that communicates with the first passageway 42.

The upper portion 46 of the handle portion 28 of the housing 12 further has an uppermost wall 54 that extends from the forwardmost wall 50 thereof, to the rearwardmost wall 48 thereof.

The uppermost wall 54 of the upper portion 46 of the handle portion 28 of the housing 12 has an inner surface 55, and an on/off switch throughbore 56 that extends vertically therethrough and is disposed approximately midway between the forwardmost wall 50 of the upper portion 46 of the handle portion 28 of the housing 12 and the rearwardmost wall 48 of the upper portion 46 of the handle portion 28 of the housing 12.

The upper portion 46 of the handle portion 28 of the housing 12 further has a battery access cap 58 that is disk-shaped, and has an inner surface 57 with a center, and external threads 59 that threadably engage with the internal threads 51 in, so as to selectively close, the forwardmost wall 50 of the upper portion 46 of the handle portion 28 of the housing 12.

The body portion 30 of the housing 12 comprises at least one telescoping tube 60 that is telescopically and coaxially received in the lower portion 32 of the handle portion 28 of the housing 12, and is extendable therefrom and retractable therein, through the forwardmost wall 36 of the lower portion 32 of the handle portion 28 of the housing 12.

The at least one telescoping tube 60 of the body portion 30 of the housing 12 has a rearwardmost end 62 that is retained in the lower portion 32 of the handle portion 28 of the housing 12 so as to prevent the at least one telescoping tube 60 of the body portion 30 of the housing 12 from separating from the lower portion 32 of the handle portion 28 of the housing 12 during telescoping.

The at least one telescoping tube 60 of the body portion 30 of the housing 12 further has a forwardmost end 64.

The battery interface 14 comprises an on/off slide switch 66 that extends outwardly in the on/off switch throughbore 56 in the uppermost wall 54 of the upper portion 46 of the handle portion 28 of the housing 12 for activating by the thumb (not shown) of the user (not shown) when the handle portion 28 of the housing 12 is held in the hand (not shown) of the user (not shown).

The battery interface 14 further comprises a coil spring 68 for electrically communicating with the negative terminal 20 of the at least one battery 16, and extends inwardly from the center of the inner surface 57 of the battery access cap 58 of the upper portion 46 of the handle portion 28 of the housing 12.

The battery interface 14 further comprises a first electrical connector 70 that electrically communicates the coil spring 68 with the on/off slide switch 66, and which extends from the coil spring 69, upwardly along the inner surface 57 of the battery access cap 58 of the upper portion 46 of the handle portion 28 of the housing 12 and rearwardly along the inner surface 55 of the uppermost wall 54 of the upper portion 46 of the handle portion 28 of the housing 12, to the on/off slide switch 66.

The first electrical connector 70 is a first strip of electrically conducting material that is partially insulated.

The battery interface 14 further comprises a second electrical connector 72 that electrically communicates with the on/off slide switch 66, and extends therefrom, rearwardly along the inner surface 55 of the uppermost wall 54 of the upper portion 46 of the handle portion 28 of the housing 12, and depends therefrom at a depending portion 73 thereof, just inward of the rearwardmost wall 48 of the upper portion 46 of the handle portion 28 of the housing 12 and the rearwardmost wall 34 of the lower portion 32 of the handle portion 28 of the housing 12, to an elevation of the first circuity affixing throughbore 39 in the rearwardmost wall 34 of the lower portion 32 of the handle portion 28 of the housing 12.

The second electrical connector 72 is a second strip of electrically conducting material that is partially insulated.

The battery interface 14 further comprises a third electrical connector 74 for electrically communicating with the positive terminal 18 of the at least one battery 16, and which depends from the positive terminal 18 of the at least one battery 16, to an elevation of the second circuity affixing throughbore 41 in the rearwardmost wall 34 of the lower portion 32 of the handle portion 28 of the housing 12.

The third electrical connector 74 is a third strip of electrically conducting material that is partially insulated.

The third electrical connector 74 is parallel to, and disposed to a side of, the depending portion 73 of the second electrical connector 72.

The bulb interface 22 comprises a head 76 that extends coaxially from the forwardmost end 64 of the at least one telescoping tube 60 of the body portion 30 of the housing 12.

The head 76 has a rearwardmost portion 78 that is disk-shaped and extends coaxially from, and is slightly wider than, the forwardmost end 64 of the at least one telescoping tube 60 of the body portion 30 of the housing 12.

The rearwardmost portion 78 of the head 76 has a rearwardmost surface 80 that is circular and disposed on, and coaxially to, the forwardmost end 64 of the at least one telescoping tube 60 of the body portion 30 of the housing 12.

The rearwardmost portion 78 of the head 76 further has a forwardmost surface 82 that is circular and disposed oppositely to the rearwardmost surface 80 thereof.

The rearwardmost portion 78 of the head 76 further has a pair of circuitry throughbores 84 that extend axially therethrough, from the rearwardmost surface 80 thereof, to the forwardmost surface 82 thereof, and are vertically spaced-apart and parallel to each other.

The head 76 further has an intermediate portion 86 that is conically-frustum-shaped and extends coaxially from the rearwardmost portion 78 thereof.

The intermediate portion 86 of the head 76 has a rearwardmost surface 88 that is circular, and disposed on, and is coincident with, the forwardmost surface 82 of the rearwardmost portion 78 of the head 76.

The intermediate portion 86 of the head 76 further has a forwardmost surface 90 that is circular and disposed oppositely and coaxially to, and is wider than, the rearwardmost surface 88 thereof.

The intermediate portion 86 of the head 76 has a circuitry throughbore 92 that is cylindrically-shaped and extends axially and centrally therethrough, from the rearwardmost surface 88 thereof, where it communicates with the pair of circuitry throughbores 82 in the rearwardmost portion 78 of the head 76, to the forwardmost surface 90 thereof, where it decreases in diameter.

The head 76 further has a forwardmost portion 94 that is cylindrically-shaped and extends coaxially from the intermediate portion 86 thereof.

The forwardmost portion 94 of the head 76 has a rearwardmost surface 96 that is circular, and disposed on, and is coincident with, the forwardmost surface 90 of the intermediate portion 86 of the head 76.

The forwardmost portion 94 of the head 76 further has a forwardmost surface 98 that is circular and disposed oppositely and coaxially to the rearwardmost surface 96 thereof.

The forwardmost portion 94 of the head 76 further has a bulb throughbore 100 that extends axially and centrally therethrough, from the rearwardmost surface 96 thereof, where it coaxially communicates with the circuitry throughbore 92 in the intermediate portion 86 of the head 76, to the forwardmost surface 98 thereof.

The bulb throughbore 100 in the forwardmost portion 94 of the head 76 has a rearwardmost portion 102 that is cylindrically-shaped and extends coaxially from the rearwardmost surface 96 of the forwardmost portion 94 of the head 76, where it coaxially communicates and is coincident with the circuitry throughbore 92 in the intermediate portion 86 of the head 76, to approximately midway between the rearwardmost surface 96 of the forwardmost portion 94 of the head 76 and the forwardmost surface 98 of the forwardmost portion 94 of the head 76.

The rearwardmost portion 102 of the bulb throughbore 100 in the forwardmost portion 94 of the head 76 has internal threads 104 that extend axially therein.

The bulb throughbore 100 in the forwardmost portion 94 of the head 76 further has a forwardmost portion 106 that is cylindrically-shaped and extends coaxially from, communicates with, and has a diameter significantly larger than, the rearwardmost portion 102 thereof, to the forwardmost surface 98 of the forwardmost portion 94 of the head 76.

The forwardmost portion 106 of the bulb throughbore 100 in the forwardmost portion 94 of the head 76 has internal threads 108 that extend axially therein.

The bulb interface 22 further comprises a bulb socket 110 that extends coaxially in the rearwardmost portion 102 of the bulb throughbore 100 in the forwardmost portion 94 of the head 76 and is for holding the bulb 24 coaxially in the rearwardmost portion 102 of the bulb throughbore 100 in the forwardmost portion 94 of the head 76 and is for allowing the bulb 24 to extend coaxially into the forwardmost portion 106 of the bulb throughbore 100 in the forwardmost portion 94 of the head 76 and coaxially into the circuitry throughbore 92 in the intermediate portion 86 of the head 76 of the bulb interface 22.

The bulb socket 110 has a positive terminal 112 and a negative terminal 114.

The negative terminal 114 of the bulb socket 110 is a ring for encircling and electrically communicating with the negative terminal of the bulb 24, and which is disposed in the rearwardmost portion 102 of the bulb throughbore 100 in the forwardmost portion 94 of the head 76.

The positive terminal 124 of the bulb socket 110 is a contact for electrically communicating with the positive terminal of the bulb 24, and which is disposed in the circuitry throughbore 92 in the intermediate portion 86 of the head 76.

The bulb interface 22 further comprises a beacon 116 that extends coaxially from the forwardmost end 98 of the head 76.

The beacon 116 has a rearwardmost portion 118 that is cylindrically-shaped, extends in the rearwardmost portion 102 of the bulb throughbore 100 in the forwardmost portion 94 of the head 76, and has external threads 120 that threadably engage with the internal threads 104 in the rearwardmost portion 102 of the bulb throughbore 100 in the forwardmost portion 94 of the head 76.

The rearwardmost portion 118 of the beacon 116 has a rearwardmost surface 122 that is circular.

The rearwardmost portion 118 of the beacon 116 further has a forwardmost surface 124 that is circular and disposed oppositely to the rearwardmost surface 122 thereof.

The rearwardmost portion 118 of the beacon 116 has a bulb throughbore 126 that extends axially therethrough, from the rearwardmost surface 122 thereof, to the forwardmost surface 124 thereof for receiving the bulb 24.

The beacon 116 further has an intermediate portion 128 that is cylindrically-shaped and extends coaxially from the rearwardmost portion 118 thereof.

The intermediate portion 128 of the beacon 116 has a rearwardmost surface 130 that is circular and coaxially disposed on, and is significantly wider than, the forwardmost surface 124 of the rearwardmost portion 118 of the beacon 116.

The intermediate portion 128 of the beacon 116 further has a forwardmost surface 132 that is circular and disposed oppositely and coaxially to, the rearwardmost surface 130 thereof.

The intermediate portion 128 of the beacon 116 further has external threads 133 that extend axially thereon from the rearwardmost surface 130 thereof, to approximately midway between the rearwardmost surface 130 thereof and the forwardmost surface 132 thereof, and threadably engage with the internal threads 108 in the forwardmost portion 106 of the bulb throughbore 100 in the forwardmost portion 94 of the head 76.

The intermediate portion 128 of the beacon 116 further has a reflector throughbore 134 that is conically-frustum-shaped and extends axially and centrally therethrough, from the rearwardmost surface 130 thereof, where it communicates with the bulb throughbore 126 in the rearwardmost portion 118 of the beacon 116, to the forwardmost surface 132 thereof, where it increases in diameter.

The intermediate portion 128 of the beacon 116 further has a reflector 136 that lines the reflector throughbore 134 therein.

The beacon 116 further has a forwardmost portion 138 that is cylindrically-shaped and extends coaxially from the intermediate portion 128 thereof.

The forwardmost portion 138 of the beacon 116 has a rearwardmost surface 140 that is circular and disposed on, and is coincident with, the forwardmost surface 132 of the intermediate portion 128 of the beacon 116.

The forwardmost portion 138 of the beacon 116 further has a forwardmost surface 142 that is circular and disposed oppositely and coaxially to the rearwardmost surface 140 thereof.

The forwardmost portion 138 of the beacon 116 further has an illuminating throughbore 144 that extends axially and centrally therethrough, from the rearwardmost surface 140 thereof, where it coaxially communicates with the reflector throughbore 134 in the intermediate portion 128 of the beacon 116, to the forwardmost surface 142 thereof.

The forwardmost portion 138 of the beacon 116 is clear plastic for allowing the bulb 24 to illuminate therethrough.

The circuity 26 comprises a positive rod 146 that is telescopic, electrically conductive, and extends axially in the lower portion 38 of the handle portion 28 of the housing 12 and axially in, and moves telescopically with, the body portion 30 of the housing 12.

The positive rod 146 has a rearwardmost end 148 that electrically communicates with, and attaches to, the third electrical connector 74, by a first screw 150 that extends axially through the second circuity affixing throughbore 41 in the rearwardmost wall 34 of the lower portion 32 of the handle portion 28 of the housing 12, through the third electrical connector 74, and axially into the rearwardmost end 148 of the positive rod 146.

The positive rod 146 further has a forwardmost end 152 that is narrower than the rearwardmost end 148 thereof, and extends through, and moves with, an uppermost one of the pair of circuitry throughbores 84 in the rearwardmost portion 78 of the head 76, to, and electrically communicates with, the positive terminal 112 of the bulb socket 110.

The circuity 26 further comprises a negative rod 154 that is telescopic, electrically conductive, and extends axially in the lower portion 38 of the handle portion 28 of the housing 12 and axially in, and moves telescopically with, the body portion 30 of the housing 12, and is disposed below, to a side of, and parallel to, the positive rod 146.

The negative rod 154 has a rearwardmost end 156 that electrically communicates with, and attaches to, the second electrical connector 72, by a second screw 158 that extends axially through the first circuity affixing throughbore 39 in the rearwardmost wall 34 of the lower portion 32 of the handle portion 28 of the housing 12, through the depending portion 73 of the second electrical connector 72, and axially into the rearwardmost end 156 of the negative rod 154.

The negative rod 154 further has a forwardmost end 160 that is narrower than the rearwardmost end 156, extends through, and moves with, a lowermost one of the pair of circuitry throughbores 84 in the rearwardmost portion 78 of the head 76, to, and electrically communicates with, the negative terminal 114 of the bulb socket 110.

The circuitry 26 further comprises a pair of spacers 162 that are disposed in the lower portion 38 of the handle portion 28 of the housing 12, and receive to prevent movement of, the rearwardmost end 148 of the positive rod 146 and the rearwardmost end 156 of the negative rod 154.

The pair of spacers 162 are parallel to each other, axially spaced-apart, and figure-8 shaped.

Each spacer 162 has an uppermost throughbore 164 that receives, to prevent movement of, the rearwardmost end 148 of the positive rod 146

Each spacer 162 further has a lowermost throughbore 166 that receives, to prevent movement of, the rearwardmost end 156 of the negative rod 154.

The pair of spacers 162 extend vertically from short of the uppermost wall 40 of the lower portion 32 of the handle portion 28 of the housing 12 so as to provide a first space 168 therebetween, to short of the lowermost wall 38 of the lower portion 32 of the handle portion 28 of the housing 12 so as to provide a second space 170 therebetween, with the first space 168 and the second space 170 providing clearance for the body portion 30 of the housing 12 to telescope through when retracting therein and extending thereout.

It will be understood that each of the elements described above, or two or more together, may also find a useful application in other types of constructions differing from the types described above.

While the invention has been illustrated and described as embodied in a telescopic flashlight, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A telescopic flashlight, comprising:

a) a housing being telescopic and being for being hand-held;

b) a battery interface disposed in said housing for interfacing with at least one battery having:

i) a positive terminal; and ii) a negative terminal;

c) a bulb interface disposed relative to said housing, electrically communicating with said battery interface, and being for interfacing with a bulb having:

i) a positive terminal; and ii) a negative terminal; and d) circuity disposed in said housing and electrically communicating said bulb interface with said battery interface, wherein said housing comprises:

i) a handle portion for holding by a user; and ii) a body portion that is telescopically attached to, and extends from and retracts into, said handle portion thereof, wherein said handle portion of said housing comprises a lower portion that is slender, elongated, and tubular, wherein said lower portion of said handle portion of said housing has:

A) a rearwardmost wall that is closed and circular-shaped; and

B) a forwardmost wall that is open and circular-shaped.

2. The flashlight as defined in claim 1, wherein said lower portion of said handle portion of said housing further has a lowermost wall that is closed and extends from said rearwardmost wall thereof, to said forwardmost wall thereof.

3. The flashlight as defined in claim 2, wherein said rearwardmost wall of said lower portion of said handle portion of said housing has a first circuitry affixing throughbore that extends axially therethrough and which is disposed in proximity to said lowermost wall of said lower portion of said handle portion of said housing.

4. The flashlight as defined in claim 3, wherein said lower portion of said handle portion of said housing further has an uppermost wall that is partially open and extends from said forwardmost wall thereof, to short of said rearwardmost wall thereof so as to provide a first passageway therebetween.

5. The flashlight as defined in claim 4, wherein said rearwardmost wall of said lower portion of said handle portion of said housing further has a second circuitry affixing throughbore that extends axially therethrough and is disposed in proximity to said uppermost wall of said lower portion of said handle portion of said housing, and to one side of, and above, said first circuitry affixing throughbore therein.

6. The flashlight as defined in claim 2, wherein said lowermost wall of said lower portion of said handle portion of said housing contains finger recesses therein that are axially spaced-apart and extend from said rearwardmost wall of said lower portion of said handle portion of said housing, to approximately midway between said rearwardmost wall of said lower portion of said handle portion of said housing and said forwardmost wall of said lower portion of said handle portion of said housing for receiving the fingers of the user.

7. The flashlight as defined in claim 5, wherein said handle portion of said housing further comprises an upper portion that is slender, elongated, and tubular.

8. The flashlight as defined in claim 7, wherein said upper portion of said handle portion of said housing has a rearwardmost wall that is closed, circular-shaped, and coplanar with said rearwardmost wall of said lower portion of said handle portion of said housing so as to form a figure 8 therewith.

9. The flashlight as defined in claim 8, wherein said upper portion of said handle portion of said housing further has a forwardmost wall that is open, circular-shaped, has internal threads, and extends from said uppermost wall of, and forms a figure 8 with, said lower portion of said handle portion of said housing, and is disposed approximately midway between said rearwardmost wall of said lower portion of said handle portion of said housing and said forwardmost wall of said lower portion of said handle portion of said housing.

10. The flashlight as defined in claim 9, wherein said upper portion of said handle portion of said housing further has a lowermost wall that is partially coincident with said uppermost wall of, and forms a figure 8 with, said lower portion of said handle portion of said housing.

11. The flashlight as defined in claim 10, wherein said lowermost wall of said upper portion of said handle portion of said housing is partially open and extends from said forwardmost wall of said upper portion of said handle portion of said housing, to short of said rearwardmost wall of said upper portion of said handle portion of said housing so as to provide a second passageway therebetween that communicates with said first passageway.

12. The flashlight as defined in claim 9, wherein said upper portion of said handle portion of said housing further has an uppermost wall that extends from said forwardmost wall thereof, to said rearwardmost wall thereof.

13. The flashlight as defined in claim 12, wherein said uppermost wall of said upper portion of said handle portion of said housing has:

a) an inner surface; and b) an on/off switch throughbore that extends vertically therethrough and is disposed approximately midway between said forwardmost wall of said upper portion of said handle portion of said housing and said rearwardmost wall of said upper portion of said handle portion of said housing.

14. The flashlight as defined in claim 13, wherein said upper portion of said handle portion of said housing further has a battery access cap that is disk-shaped, and has an inner surface with a center, and external threads that threadably engage with said internal threads in, so as to selectively close, said forwardmost wall of said upper portion of said handle portion of said housing.

15. The flashlight as defined in claim 14, wherein said body portion of said housing comprises at least one telescoping tube that is telescopically and coaxially received in said lower portion of said handle portion of said housing, and is extendable therefrom and retractable therein, through said forwardmost wall of said lower portion of said handle portion of said housing.

16. The flashlight as defined in claim 15, wherein said at least one telescoping tube of said body portion of said housing has a rearwardmost end that is retained in said lower portion of said handle portion of said housing so as to prevent said at least one telescoping tube of said body portion of said housing from separating from said lower portion of said handle portion of said housing.

17. The flashlight as defined in claim 15, wherein said at least one telescoping tube of said body portion of said housing further has a forwardmost end.

18. The flashlight as defined in claim 17, wherein said battery interface comprises an on/off slide switch that extends outwardly in said on/off switch throughbore in said uppermost wall of said upper portion of said handle portion of said housing for activating by the thumb of the user when said handle portion of said housing is held in the hand of the user.

19. The flashlight as defined in claim 18, wherein said battery interface further comprises a coil spring for electrically communicating with the negative terminal of the at least one battery, and which extends inwardly from said center of said inner surface of said battery access cap of said upper portion of said handle portion of said housing.

20. The flashlight as defined in claim 19, wherein said battery interface further comprises a first electrical connector that electrically communicates said coil spring with said on/off slide switch, and extends from said coil spring, upwardly along said inner surface of said battery access cap of said upper portion of said handle portion of said housing and rearwardly along said inner surface of said uppermost wall of said upper portion of said handle portion of said housing, to said on/off slide switch.

21. The flashlight as defined in claim 20, wherein said first electrical connector is a first strip of electrically conducting material that is partially insulated.

22. The flashlight as defined in claim 18, wherein said battery interface further comprises a second electrical connector that electrically communicates with said on/off slide switch, and extends therefrom, rearwardly along said inner surface of said uppermost wall of said upper portion of said handle portion of said housing, and depends therefrom, at a depending portion thereof, just inward of said rearwardmost wall of said upper portion of said handle portion of said housing and said rearwardmost wall of said lower portion of said handle portion of said housing, to an elevation of said first circuity affixing throughbore in said rearwardmost wall of said lower portion of said handle portion of said housing.

23. The flashlight as defined in claim 22, wherein said second electrical connector is a second strip of electrically conducting material that is partially insulated.

24. The flashlight as defined in claim 22, wherein said battery interface further comprises a third electrical connector for electrically communicating with the positive terminal of the at least one battery, and which depends from the positive terminal of the at least one battery, to an elevation of said second circuity affixing throughbore in said rearwardmost wall of said lower portion of said handle portion of said housing.

25. The flashlight as defined in claim 24, wherein said third electrical connector is a third strip of electrically conducting material that is partially insulated.

26. The flashlight as defined in claim 22, wherein said third electrical connector is parallel to, and is disposed to a side and inward of, said depending portion of the second electrical connector.

27. The flashlight as defined in claim 24, wherein said bulb interface comprises a head that extends coaxially from said forwardmost end of said at least one telescoping tube of said body portion of said housing.

28. The flashlight as defined in claim 27, wherein said head has a rearwardmost portion that is disk-shaped and extends coaxially from, and is slightly wider than, said forwardmost end of said at least one telescoping tube of said body portion of said housing.

29. The flashlight as defined in claim 28, wherein said rearwardmost Portion of said head has a rearwardmost surface that is circular and disposed on, and coaxially to, said forwardmost end of said at least one telescoping tube of said body portion of said housing.

30. The flashlight as defined in claim 29, wherein said rearwardmost portion of said head further has a forwardmost surface that is circular and disposed oppositely to said rearwardmost surface thereof.

31. The flashlight as defined in claim 30, wherein said rearwardmost portion of said head further has a pair of circuitry throughbores that extend axially therethrough, from said rearwardmost surface thereof, to said forwardmost surface thereof, and are vertically spaced-apart and parallel to each other.

32. The flashlight as defined in claim 31, wherein said head further has an intermediate portion that is conically-frustum-shaped and extends coaxially from said rearwardmost portion thereof.

33. The flashlight as defined in claim 32, wherein said intermediate portion of said head has a rearwardmost surface that is circular and disposed on, and is coincident with, said forwardmost surface of said rearwardmost portion of said head.

34. The flashlight as defined in claim 33, wherein said intermediate portion of said head further has a forwardmost surface that is circular and disposed oppositely and coaxially to, and is wider than, said rearwardmost surface thereof.

35. The flashlight as defined in claim 34, wherein said intermediate portion of said head further has a circuitry throughbore that is cylindrically-shaped and extends axially and centrally therethrough, from said rearwardmost surface thereof, where it communicates with said pair of circuitry throughbores in said rearwardmost portion of said head, to said forwardmost surface thereof, where it decreases in diameter.

36. The flashlight as defined in claim 35, wherein said head further has a forwardmost portion that is cylindrically-shaped and extends coaxially from said intermediate portion thereof.

37. The flashlight as defined in claim 36, wherein said forwardmost portion of said head has a rearwardmost surface that is circular and disposed on, and is coincident with, said forwardmost surface of said intermediate portion of said head.

38. The flashlight as defined in claim 37, wherein said forwardmost portion of said head further has a forwardmost surface that is circular and disposed oppositely and coaxially to said rearwardmost surface thereof.

39. The flashlight as defined in claim 38, wherein said forwardmost portion of said head has a bulb throughbore that extends axially and centrally therethrough, from said rearwardmost surface thereof, where it coaxially communicates with said circuitry throughbore in said intermediate portion of said head, to said forwardmost surface thereof.

40. The flashlight as defined in claim 39, wherein said bulb throughbore in said forwardmost portion of said head has a rearwardmost portion that is cylindrically-shaped and extends coaxially from said rearwardmost surface of said forwardmost portion of said head, where it coaxially communicates and is coincident with, said circuitry throughbore in said intermediate portion of said head, to approximately midway between said rearwardmost surface of said forwardmost portion of said head and said forwardmost surface of said forwardmost portion of said head.

41. The flashlight as defined in claim 40, wherein said rearwardmost portion of said bulb throughbore in said forwardmost portion of said head has internal threads that extend axially therein.

42. The flashlight as defined in claim 41, wherein said bulb throughbore in said forwardmost portion of said head further has a forwardmost portion that is cylindrically-shaped and extends coaxially from, communicates with, and has a diameter significantly larger than, said rearwardmost portion thereof, to said forwardmost surface of said forwardmost portion of said head.

43. The flashlight as defined in claim 42, wherein said forwardmost portion of said bulb throughbore in said forwardmost portion of said head has internal threads that extend axially therein.

44. The flashlight as defined in claim 42, wherein said bulb interface further comprises a bulb socket that extends coaxially in said rearwardmost portion of said bulb throughbore in said forwardmost portion of said head and is for holding the bulb coaxially in said rearwardmost portion of said bulb throughbore in said forwardmost portion of said head and for allowing the bulb to extend coaxially into said forwardmost portion of said bulb throughbore in said forwardmost portion of said head and coaxially into said circuitry throughbore in said intermediate portion of said head of said bulb interface.

45. The flashlight as defined in claim 44, wherein said bulb socket has:

a) a positive terminal; and b) a negative terminal.

46. The flashlight as defined in claim 45, wherein said negative terminal of said bulb socket is a ring for encircling, and electrically communicating with, the negative terminal of the bulb, and which is disposed in said rearwardmost portion of said bulb throughbore in said forwardmost portion of said head.

47. The flashlight as defined in claim 45, wherein said positive terminal of said bulb socket is a contact for electrically communicating with the positive terminal of the bulb, and which is disposed in said circuitry throughbore in said intermediate portion of said head.

48. The flashlight as defined in claim 43, wherein said bulb interface further comprises a beacon that extends coaxially from said forwardmost end of said head.

49. The flashlight as defined in claim 48, wherein said beacon has a rearwardmost portion that is cylindrically-shaped, extends in said rearwardmost portion of said bulb throughbore in said forwardmost portion of said head, and has external threads that threadably engage with said internal threads in said rearwardmost portion of said bulb throughbore in said forwardmost portion of said head.

50. The flashlight as defined in claim 49, wherein said rearwardmost portion of said beacon further has a rearwardmost surface that is circular.

51. The flashlight as defined in claim 50, wherein said rearwardmost portion of said beacon further has a forwardmost surface that is circular and disposed oppositely to said rearwardmost surface thereof.

52. The flashlight as defined in claim 51, wherein said rearwardmost portion of said beacon has a bulb throughbore that extends axially therethrough, from said rearwardmost surface thereof, to said forwardmost surface thereof for receiving the bulb.

53. The flashlight as defined in claim 52, wherein said beacon further has an intermediate portion that is cylindrically-shaped and extends coaxially from said rearwardmost portion thereof.

54. The flashlight as defined in claim 53, wherein said intermediate portion of said beacon has a rearwardmost surface that is circular and coaxially disposed on, and is wider than, said forwardmost surface of said rearwardmost portion of said beacon.

55. The flashlight as defined in claim 54, wherein said intermediate portion of said beacon further has a forwardmost surface that is circular and disposed oppositely and coaxially to said rearwardmost surface thereof.

56. The flashlight as defined in claim 55, wherein said intermediate portion of said beacon further has a reflector throughbore that is conically-frustum-shaped and extends axially and centrally therethrough, from said rearwardmost surface thereof, where it communicates with said bulb throughbore in said rearwardmost portion of said beacon, to said forwardmost surface thereof, where it increases in diameter.

57. The flashlight as defined in claim 56, wherein said intermediate portion of said beacon further has a reflector that lines said reflector throughbore therein.

58. The flashlight as defined in claim 56, wherein said beacon further has a forwardmost portion that is cylindrically-shaped and extends coaxially from said intermediate portion thereof.

59. The flashlight as defined in claim 58, wherein said forwardmost portion of said beacon has a rearwardmost surface that is circular and disposed on, and is coincident with, said forwardmost surface of said intermediate portion of said beacon.

60. The flashlight as defined in claim 59, wherein said forwardmost portion of said beacon further has a forwardmost surface that is circular and disposed oppositely and coaxially to said rearwardmost surface thereof.

61. The flashlight as defined in claim 60, wherein said forwardmost portion of said beacon further has an illuminating throughbore that extends axially and centrally therethrough, from said rearwardmost surface thereof, where it coaxially communicates with said reflector throughbore in said intermediate portion of said beacon, to said forwardmost surface thereof.

62. The flashlight as defined in claim 58, wherein said forwardmost portion of said beacon is clear plastic for allowing said bulb to illuminate therethrough.

63. The flashlight as defined in claim 45, wherein said circuity comprises a positive rod that is telescopic, electrically conductive, and extends axially in said lower portion of said handle portion of said housing and axially in, and moves telescopically with, said body portion of said housing.

64. The flashlight as defined in claim 63, wherein said positive rod has a rearwardmost end that electrically communicates with, and attaches to, said third electrical connector, by a first screw that extends axially through said second circuity affixing throughbore in said rearwardmost wall of said lower portion of said handle portion of said housing, through said third electrical connector, and axially into said rearwardmost end of said positive rod.

65. The flashlight as defined in claim 64, wherein said positive rod further has a forwardmost end that is narrower than said rearwardmost end, extends through, and moves with, an uppermost one of said pair of circuitry throughbores in said rearwardmost portion of said head, to, and electrically communicates with, said positive terminal of said bulb socket.

66. The flashlight as defined in claim 64, wherein said circuity further comprises a negative rod that is telescopic, electrically conductive, and extends axially in said lower portion of said handle portion of said housing and axially in, and moves telescopically with, said body portion of said housing, and is disposed below, to a side of, and parallel to, said positive rod.

67. The flashlight as defined in claim 66, wherein said negative rod has a rearwardmost end that electrically communicates with, and attaches to, said second electrical connector, by a second screw that extends axially through said first circuity affixing throughbore in said rearwardmost wall of said lower portion of said handle portion of said housing, through said depending portion of said second electrical connector, and axially into said rearwardmost end of said negative rod.

68. The flashlight as defined in claim 67, wherein said negative rod further has a forwardmost end that is narrower than said rearwardmost end, extends through, and moves with, a lowermost one of said pair of circuitry throughbores in said rearwardmost portion of said head, to, and electrically communicates with, said negative terminal of said bulb socket.

69. The flashlight as defined in claim 67, wherein said circuitry further comprises a pair of spacers that are disposed in said lower portion of said handle portion of said housing, and receive to prevent movement of, said rearwardmost end of said positive rod and said rearwardmost end of said negative rod.

70. The flashlight as defined in claim 69, wherein said pair of spacers are parallel to each other, axially spaced-apart, and figure-8 shaped.

71. The flashlight as defined in claim 69, wherein each spacer has an uppermost throughbore that receives, to prevent movement of, said rearwardmost end of said positive rod.

72. The flashlight as defined in claim 69, wherein each spacer further has a lowermost throughbore that receives, to prevent movement of, said rearwardmost end of said negative rod.

73. The flashlight as defined in claim 69, wherein said pair of spacers extend vertically from short of said uppermost wall of said lower portion of said handle portion of said housing so as to provide a first space therebetween, to short of said lowermost wall of said lower portion of said handle portion of said housing so as to provide a second space therebetween, with said first space and said second space providing clearance for said body portion of said housing to telescope through when retracting therein and extending thereout.

74. The flashlight as defined in claim 55, wherein said intermediate portion of said beacon further has external threads that extend axially thereon from said rearwardmost surface thereof, to approximately midway between said rearwardmost surface thereof and said forwardmost surface thereof, and threadably engage with said internal threads in said forwardmost portion of said bulb throughbore in said forwardmost portion of said head.

* * * * *